US008350771B1

(12) United States Patent
Zaghloul et al.

(10) Patent No.: US 8,350,771 B1
(45) Date of Patent: Jan. 8, 2013

(54) DUAL-BAND DUAL-ORTHOGONAL-POLARIZATION ANTENNA ELEMENT

(75) Inventors: Amir I Zaghloul, Bethesda, MD (US); W Mark Dorsey, Elkridge, MD (US)

(73) Assignees: The United States of America, as represented by the Secretary of the Navy, Washington, DC (US); Virginia Polytechnic Institute and State University, Blacksburg, VA (US)

( * ) Notice: Subject to any disclaimer, the term of this patent is extended or adjusted under 35 U.S.C. 154(b) by 464 days.

(21) Appl. No.: 12/792,092

(22) Filed: Jun. 2, 2010

Related U.S. Application Data

(60) Provisional application No. 61/183,266, filed on Jun. 2, 2009.

(51) Int. Cl.
*H01Q 13/10* (2006.01)

(52) U.S. Cl. ..... 343/769; 343/767; 343/700 MS

(58) Field of Classification Search ..... 343/700 MS, 343/725, 767, 768, 769, 770
See application file for complete search history.

(56) References Cited

U.S. PATENT DOCUMENTS 4,873,529 A * 10/1989 Gibson ..... 343/700 MS
5,534,877 A 7/1996 Sorbello et al.
6,008,772 A * 12/1999 Legay et al. ..... 343/787
6,114,997 A 9/2000 Lee et al.
6,288,685 B1 * 9/2001 Thomas ..... 343/769
6,424,299 B1 7/2002 Cha et al.
6,509,880 B2 * 1/2003 Sabet et al. ..... 343/770
7,986,279 B2 * 7/2011 Bruno et al. ..... 343/769

OTHER PUBLICATIONS

Bodley, M., Sarcione, M., Beltran, F . Russell, M., "Dual band cellular antenna," Wireless Applications Digest. 1997., IEEE MTT-S Symposium on Technologies, pp. 93-98, (Feb. 1997).
Cai, C.-H.; Row, J.-S.; Wong, K.-L . "Dual-frequency microstrip antenna with dual circular polarisation," Electronics Letters , vol. 42, No. 22, pp. 1261-1262 (Oct. 2006).
Duxian Liu; Gaucher, B., "A new multiband antenna for WLAN/cellular applications," Vehicular Technology Conference. 2004. VTC2004-Fall. 2004 IEEE 60th, vol. 1, pp. 243-246 (Sep. 2004).
Lindmark. B., "A dual polarized dual band microstrip antenna for wireless communications," Aerospace Conference. 1998. Proceedings., IEEE, vol. 3, pp. 333-338 (Mar. 1998).
Joo-Seong Jeon. Sang-Hoon Park. "Wideband antenna for PCS and IMT-2000 service band," Vehicular Technology Conference, 2004 VTC2004-Fall. 2004 IEEE 60th , vol. 1, pp. 216-219 (Sep. 2004).

(Continued)

*Primary Examiner* — Tho G Phan
(74) *Attorney, Agent, or Firm* — Amy L. Ressing; L. George Legg

(57) ABSTRACT

A dual-band, dual-orthogonally-polarized antenna element includes a dielectric substrate having a conductor layer that includes a square ring slot and a shorted square ring, with each having a pair of orthogonal feed points. The shorted square ring is fed with coaxial probe feeds, while the square ring slot feeds striplines terminated in open-circuited stubs for coupling energy to each pair of orthogonal feed points. The first and second stripline feeds are not coplanar in order that each stub terminates past a center point of the element. The square ring slot operates as a high frequency band radiator and the shorted square ring operates as a low frequency band radiator, and both bands radiate substantially simultaneous dual-orthogonally-polarized modes. The modes can be any combination of dual-Circular Polarization (CP) and dual-Linear Polarization (LP), depending on the geometry of the radiators.

14 Claims, 12 Drawing Sheets

OTHER PUBLICATIONS

Jefferson, R.L.; Smith, D., "Dual circular polarised microstrip antenna design for a passive microwave transponder," Antennas and Propagation, 1991. ICAP 91., Seventh International Conference on (IEE) , vol. 1, pp. 141-143 (Apr. 1991).

Bialkowski, K.S.; Zagriatski, S., "Investigations into a dual band 2.4/5.2 GHz antenna for WLAN applications," Microwaves, Radar and Wireless Communications, 2004. MIKON-2004. 15th Int. Conf on , vol. 2, no., pp. 660-663 vol. 2, May 17-19, 2004.

Hsu, S H.; Chang. K. "A Novel Reconfigurable Microstrip Antenna with Switchable Circular Polarization", IEEE Ant. and Wireless Prop. Let., vol. 6, pp. 160-162 (2007).

Sung, Y.J.; Jang, T.U.: Kim, Y.S., "A Reconfigurable Microstrip Antenna for Switchable Polarization", IEEE Micro. & Wireless Comp. Let., vol. 14, pp. 534-536 (Nov. 2004).

Fang, S.T., "A Novel Polarization Diversity Antenna for WLAN Applications", Antennas and Prop. Society International Symp., vol. 1, 16-21, pp. 282-285 (Jul. 2000).

Owens, R.P.; Smith, A.C., "Low-profile dual band, dual polarised array antenna module," Electronics Letters, vol. 26, No. 18, pp. 1433-1434, (Aug. 30, 1990).

Shafai, L.; Chamma, W.; Seguin, G.; Sultan, N., "Dual-band dual-polarized microstrip antennas for SAR applications ," Antennas and Propagation Society International Symposium, 1997. IEEE., 1997 Digest, vol. 3, no., pp. 1866-1869 vol. 3, (Jul. 13-18, 1997).

Vallecchi, A.; Gentili. G.B.: Calamia, M., "Dual-band dual polarization microstrip antenna," Antennas and Propagation Society International Symposium, 2003. IEEE, vol. 4, no., pp. 134-137 vol. 4, (Jun. 22-27,2003).

Mangenot, C. Lorenzo, J.. "Dual band dual polarized radiating subarray for synthetic aperture radar," Antennas and Propagation Society International Symposium, 1999. IEEE, vol. 3, no., pp. 1640-1643 vol. 3, (Aug. 1999).

Eade, J.C.; Whitehurst, J., "Dual band phased array antenna design for radar applications," Antennas and Propagation, 2001. Eleventh International Conference on (IEE Conf. Publ. No. 480), vol. 1, no., pp. 77-81 vol. 1. (2001).

Daniel, A.E., "Array of dual band RMSAs with bend stub along the radiating edge," Antennas and Propagation Society International Symposium, 2003. IEEE , vol. 4, no., pp. 560-563 vol. 4, (Jun. 22-27, 2003).

* cited by examiner

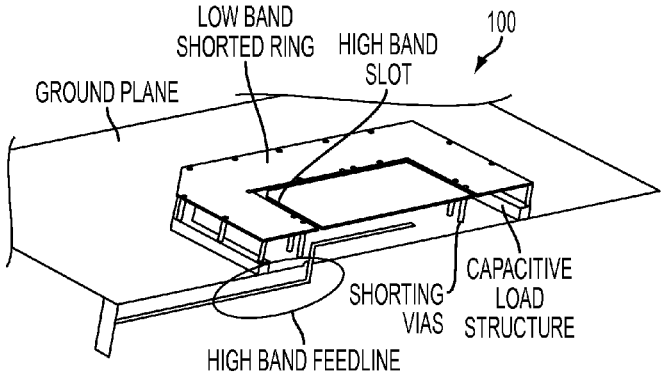
FIG. 12
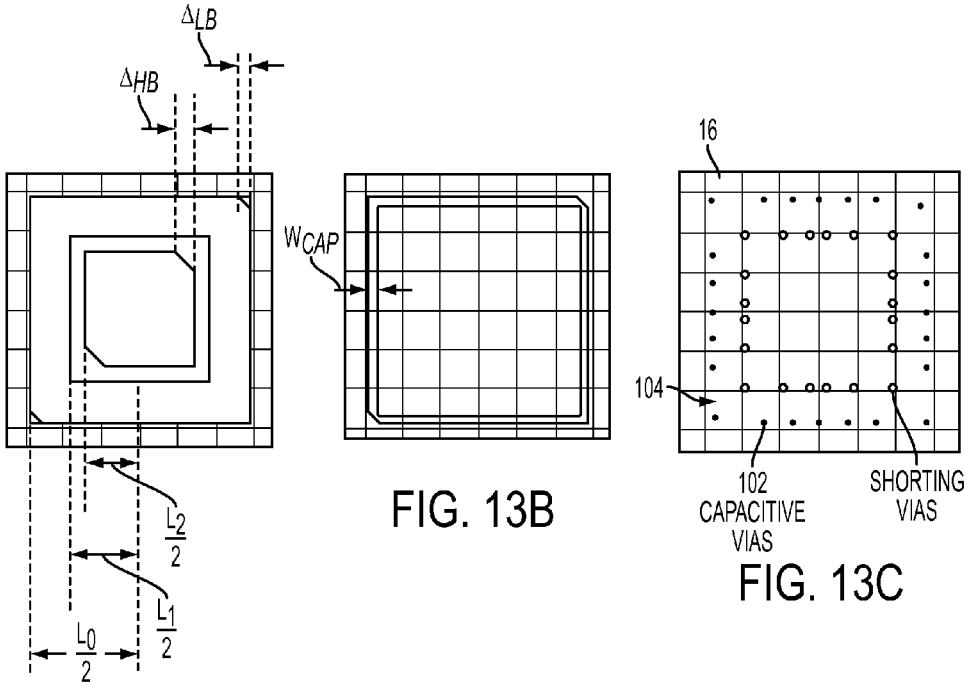
FIG. 13A
FIG. 13B
FIG. 13C

DUAL-BAND DUAL-ORTHOGONAL-POLARIZATION ANTENNA ELEMENT

CROSS-REFERENCE TO RELATED APPLICATIONS

This Application claims the benefit of U.S. Provisional Application 61/183,266 filed on Jun. 2, 2009.

TECHNICAL FIELD

The invention is directed to an antenna for transmitting and receiving radio frequency signals, and more particularly, to a dual band antenna capable of simultaneously operating with two orthogonal senses of polarization in each band.

BACKGROUND OF THE INVENTION

Antennas capable of operating at multiple frequency bands are advantageous to many applications ranging from space-based radar to personal wireless communications. Synthetic aperture radar (SAR) typically operates in L- and C-bands. For space-based SAR applications where minimizing the mass and weight of the radar system is essential to reducing the overall cost of the mission, antennas capable of operating in multiple frequency bands with multiple polarizations are beneficial. Dual-band antenna elements are also desirable in radar applications because of their ability to improve data collection rates while also allowing for true multifunction radar (MFR) operation.

Wireless communications networks have shown an increased number of subscribers as well as an increased demand for multi-band equipment. Wireless access points and laptops are both turning towards antennas capable of operating in multiple frequency bands in order to support multiple protocol. The 2.4 GHz ISM band is quickly growing in popularity for wireless communications devices due to its use in Bluetooth technology and 802.11b/g protocol. For higher data rates, the frequency band from 5.15-5.85 GHz is often used, and the 802.11a protocol operates within the 5.2 GHz ISM band. Moreover, the cell phone industry is incorporating multi-band antennas into handsets to reduce the number of antennas required to provide operation for different services, e.g. as described in Bodley, M;: Sarcione, M.; Beltran. F.; Russell, M., "Dual band cellular antenna," *Wireless Applications Digest,* 1997., *IEEE MTT-S Symposium on Technologies*. pp. 93-98, (February 1997).

Circular polarized (CP) antennas are popular choices in mobile wireless communications applications owing to their ability to allow flexible orientation between the transmitter and receiver antennas and to reduce multipath effects that can lead to signal fading. The ability to operate with both left hand (LH) and right hand (RH) senses of CP (LHCP and RHCP) allows the system to reuse frequencies and double the system capacity. In two-way data link systems, information is often transmitted by means of polarization shift keying, a technique that utilizes orthogonal senses of CP.

Dual-band and dual-polarized antennas have gained increasing popularity and have element architectures that can typically be placed into two categories: 1) a single element with a wide operational bandwidth capable of covering multiple bands or 2) an element comprised of two separate radiators, each of which is optimized for a specific frequency band. The majority of the work done on dual-band elements focuses on elements that operate with a single polarization state in each frequency band. There is some work that focuses on dual-band elements capable of supporting dual-linear operation at each band, and a minimal amount of work detailing dual-CP operation at each band. Moreover, much of the literature on dual-band operation details dual-band arrays using interleaved elements. In these designs, separate arrays of different sized elements are interleaved to form a single, dual-band aperture.

Microstrip patch antennas using the reactive stub loading has been shown to provide dual-band operation. However, each frequency band for this element operates with the same sense of linear polarization. If multiple feed locations and stubs are used, dual-linear polarization is possible. This type of elements has been shown to provide limited control of the frequency ratio between the two operational bands.

An annular ring patch radiator, e.g. as described in Cai. C.-H.; Row, J.-S.; Wong, K.-L., "Dual-frequency microstrip antenna with dual circular polarisation," *Electronics Letters*, Vol. 42, no. 22, pp. 1261-1262 (October 2006), is capable of providing CP behavior at two separate frequency bands. When this type of element is operated in CP, the magnetic currents flow clockwise around the ring slot in a given frequency band, but they will flow counterclockwise at another frequency band. This behavior provides dual-band behavior, but each band only operates with a single sense of CP. There is also limited control over the ratio of frequencies for the two bands.

The cell phone industry has led to the design of several dual-band antennas. Duxian Liu; Gaucher, B., "A new multi-band antenna for WLAN/cellular applications," *Vehicular Technology Conference,* 2004. *VTC*2004-*Fall.* 2004 *IEEE* 60*th*, Vol. 1, pp. 243-246 (September 2004) describes a design capable of covering multiple frequency bands for cellular and WLAN applications. This element uses a combination of inverted-F and L-shaped radiators to cover the multiple bands. Lindmark, B. "A dual polarized dual band microstrip antenna for wireless communications." *Aerospace Conference,* 1998. *Proceedings., IEEE*. Vol. 3. pp. 333-338 (March 1998) describes a dual-band antenna capable of covering GSM and DCS frequency bands consisting of an aperture coupled stacked patch design. Joo-Seong Jeon; Sang-Hoon Park, "Wideband antenna for PCS and IMT-2000 service band," *Vehicular Technology Conference,* 2004. *VTC*2004-*Fall.* 2004 *IEEE* 60*th*. Vol. 1, pp. 216-219 (September 2004) describes a triangular shaped patch employing a U-shaped slot and L-shaped feed in order to provide a wide bandwidth capable of covering the PCS and IMT-2000 frequency bands. In each of these elements, the given frequency bands operates with only a single sense of linear polarization.

Many of the dual-band elements with CP polarization require complex feed networks consisting of diplexers and hybrids. U.S. Pat. No. 5,815,119, "Integrated Stacked Patch Antenna Polarizer Circularly Polarized Integrated Stacked Dual-Band Patch Antenna", Helms et al., issued Sep. 29, 1998, is directed to a design for a dual-band stacked patch design where each band operates with a single sense of CP. In this design, the outputs of a 90° hybrid feed orthogonal locations on the element to generate CP. U.S. Pat. No. 6,114,997, "Low-Profile. Integrated Radiator Tiles for Wideband, Dual-Linear and Circular-Polarized Phased Array Applications". Lee et al., issued Sep. 5, 2000, describes a wideband element capable of operating with linear, CP, dual-linear, or dual-CP polarization. The possible polarization states in this element depend on the configuration of a feed network consisting of 90° and 180° hybrids. U.S. Pat. No. 6,424,299, "Dual Hybrid-Fed Patch Element for Dual-Band Circular Polarization Radiation", Cha et al., issued Jul. 23, 2002, describes a dual-band element with linear or CP operation with a hybrid feeding network.

Dual-band radiating apertures are often achieved by interleaving elements of different sizes, where each type of element has its own array lattice structure which in some designs is achieved by using perforated patches that enable a series of smaller elements to be placed within holes in the larger, low band elements. Although these purport to deal with dual-band apertures, the elements used in the design are inherently single band. The dual-band nature of the aperture stems from the arrangement of single band elements on different lattice structures.

There have been few attempts to design elements capable of simultaneously operating with orthogonal senses of CP. Jefferson, R. L.; Smith. D. "Dual circular polarised microstrip antenna design for a passive microwave transponder," *Antennas and Propagation,* 1991. *ICAP* 91., *Seventh International Conference on* (*IEE*). Vol. 1. pp. 141-143 (April 1991) discloses a nearly square microstrip patch element utilizing orthogonal feed locations to simultaneously generate right hand CP (RI ICP) and left hand CP (LHCP). This element operates over a single frequency band.

It would therefore be desirable to provide an antenna having the capability to operate in two separate bands, with each band having the ability to simultaneously operate with dual-orthogonal polarizations (either dual-linear or dual-circular).

BRIEF SUMMARY OF THE INVENTION

According to the invention, a dual-band, dual-orthogonally-polarized antenna element includes a dielectric substrate having a conductor layer that includes a square ring slot and a shorted square ring, with each having a pair of orthogonal feed points. The shorted square ring is fed with coaxial probe feeds, while the square ring slot feeds are striplines terminated in open-circuited stubs for coupling energy to each pair of orthogonal feed points. The first and second stripline feeds are not coplanar in order that each stub terminates past a center point of the element. The square ring slot operates as a high frequency band radiator and the shorted square ring operates as a low frequency band radiator, and both bands radiate substantially simultaneous dual-orthogonally-polarized modes. The modes can be any combination of dual-Circular Polarization (CP) and dual-Linear Polarization (LP), with dual-CP operation being obtained by introducing triangular perturbations at opposing corners of that radiator for which dual CP operation is desired.

The advantages of this element arise from its ability to radiate dual-circular or dual-linear polarization at each of the two operational frequency bands. This allows the user to utilize maximum polarization diversity in a given system. The four-port feeding allows the polarizations to be used simultaneously. The majority of dual-band elements in the literature are not capable of providing simultaneous dual-CP operation at each polarization bands.

There are no couplers, hybrids, multiplexers, or active components required in the feed network which makes the circuitry simple and cost effective. This provides an advantage over other feeding techniques approaches.

The dual-band nature of this element stems from the presence of two separate radiating structures. The antenna engineer has flexibility over the dimensions selected for this element which, in turn, provides flexibility over the frequency ratio between the two bands. This provides an advantage over previous dual-band elements designs.

The ability of this element to be placed in a uniform array lattice is another strong advantage for this element. Other dual-band radiating apertures created from interleaving arrays of different sizes on different lattice structures prove difficult to physically arrange their element footprints to avoid overlapping while at the same time maintain proper spacing to avoid grating lobes. The present element eliminates the need to interleave elements.

The invention is a dual-band antenna element in which each band can simultaneously operate with two orthogonal senses of circular polarization. The element uses a printed circuit design that provides a low profile, light weight, and low cost design desirable for integration with laptop technology, wireless access points, space born radars, cellular phone handsets and bases stations, and many other areas of the ever growing field of wireless communications. The ability to integrate the dual-substrate capacitive loading technique for size reduction in this element makes the element suitable for integration into a dual-band array with uniform lattice spacing; this makes the element attractive to synthetic aperture radar and multifunction radar applications.

The invention provides the ability to operate in two separate bands, with each band having the ability to simultaneously operate with dual-orthogonal polarizations (either dual-linear or dual-circular). Moreover, this element can be combined with a size reduction technique to allow for it to be used in array environments. This size reduction of the low band provides a way to space this element on an array lattice that can avoid grating lobes at both frequency bands at wide scan angles.

BRIEF DESCRIPTION OF THE DRAWINGS

FIG. 12 is an isometric view of the dual-band element showing dual-substrate capacitive loading according to the invention;

FIG. 13 is a top view of the dual-band element layers showing dual-substrate capacitive loading according to the invention;

DETAILED DESCRIPTION OF THE INVENTION

Figure 1:
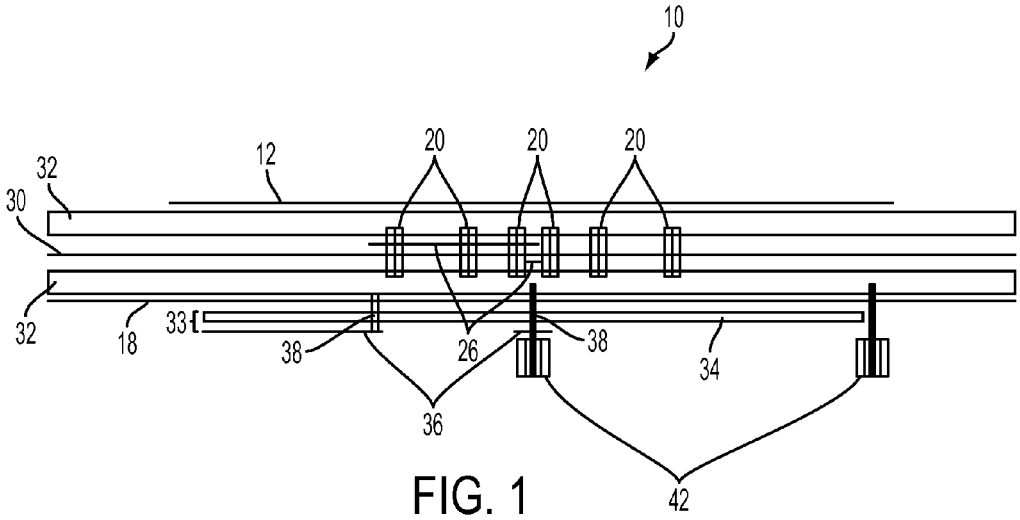
FIG. 1 is an exploded side view of a dual-band dual-CP element according to the invention.
Figure 2:
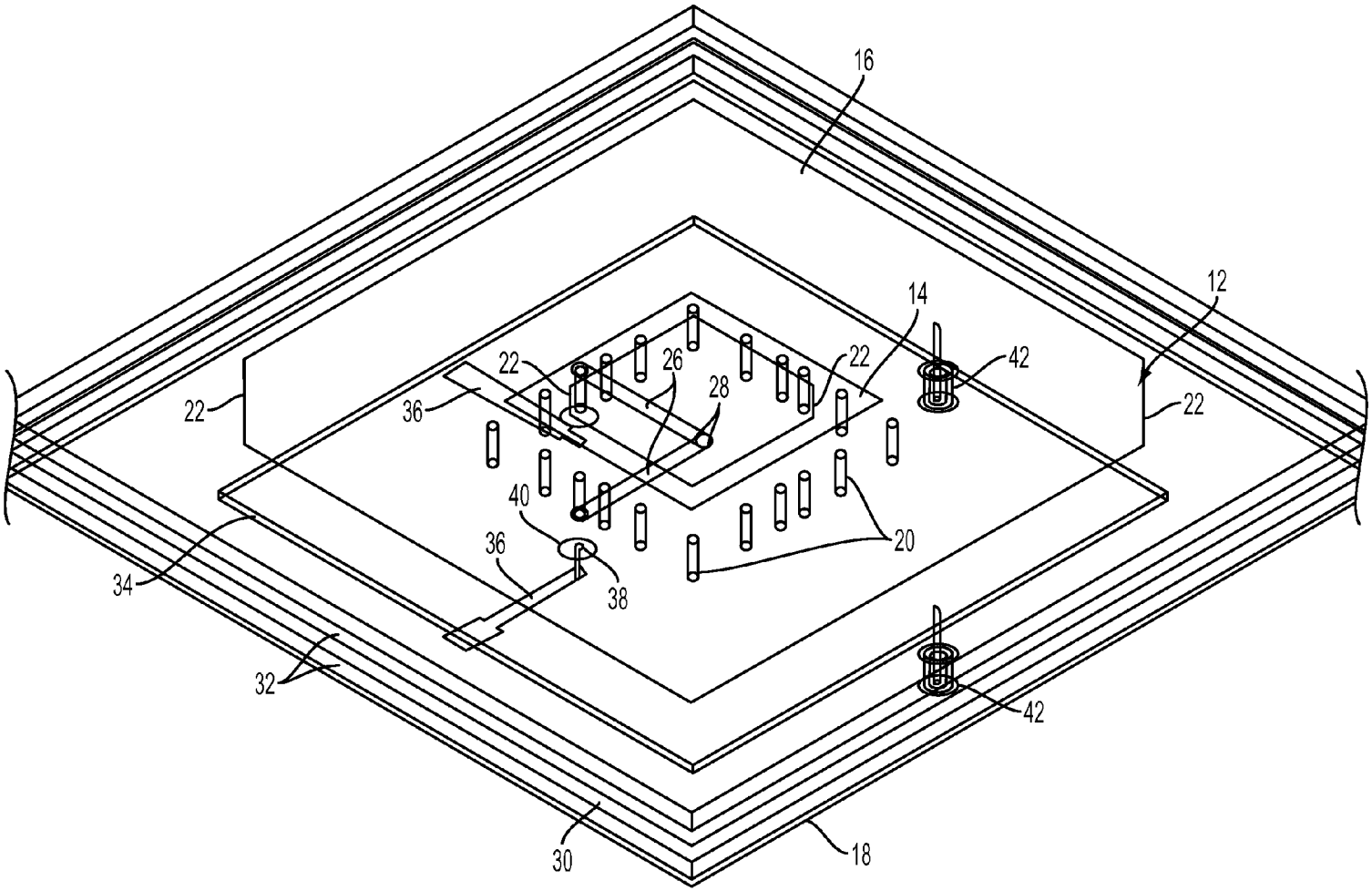
FIG. 2 is an exploded isometric view of a dual-band dual-CP element according to the invention.
Figure 3:
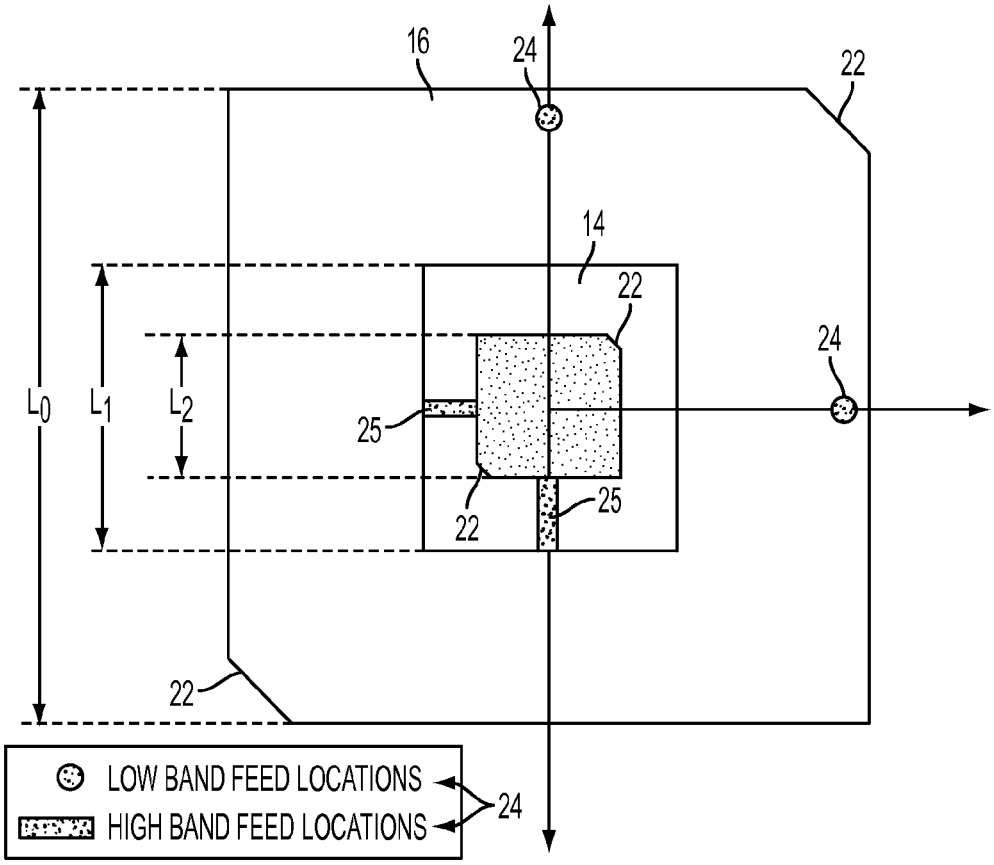
FIG. 3 is a top view of the low and high band radiators of a dual-band dual-CP element according to the invention.

Referring now to FIGS. 1-5, a dual-band dual-orthogonally-polarized element 10 according to the invention includes a stratified arrangement of microwave substrate layers and planar conductor layers with vertical plated through holes providing interconnections between specified conductor layers. Conductor layer 12 includes a square ring slot 14 that operates as a slotted stripline circuit and is the high band radiator. Conductor layer 12 also includes a shorted square ring 16 that is present outside of the square ring slot 14 and serves as the low band radiator. The low band radiator is shorted to a conductor layer 18 that serves as the ground plane for the element with plated through holes 20 located at the inner perimeter of the shorted square ring 16. Isosceles triangular perturbations 22 are present at opposing corners of both the shorted square ring 16 and square ring slot 14. The use of these perturbations creates two, near-degenerate modes that excite CP with a single feed point. The location of the feed point with respect to the truncated corners determines the sense of CP (either right-hand or left-hand). Therefore, by having two orthogonal feed points 24 (low band) and 25 (high band) for each band, element 10 as shown is capable of generating simultaneous dual-CP operation for each frequency range. FIG. 3 illustrates exemplary relative dimensions for element 10, with the shorted square ring 16 having an outer side length $L_0$ and inner side length $L_1$, and the square ring slot 14 having outer and inner side lengths of $L_1$ and $L_2$ respectively. The feed points 24 and 25 and triangular perturbations 22 are also indicated.

The square ring slot 14 is fed with orthogonal stripline feeds 26. These stripline feeds 26 pass through underneath of the square ring slot 14, and they are terminated in open circuited stubs 28—in FIG. 4, a hidden stub 28 is actually situated under the other stub 28 as per the following discussion. In many instances, the ideal stub length for achieving the best axial ratio and impedance match results in the feed line ending past the center point of the element. If the orthogonal feed lines were present in the same plane, they would physically intersect as they passed this center point. In order to eliminate this problem, a thin substrate termed herein the feed substrate 30 is placed at the center of the dielectric profile. The two stripline feeds 26 are printed on opposing surfaces of the feed substrate 30. The feed substrate 30 is then sandwiched between two other dielectric substrate layers 32 and conductors 12 and 18 are present on the top and bottom of the sandwiched dielectric profile. Stubs 28 accordingly are not coplanar with each terminating at or past the center point but without one stripline feed 26 contacting the other stripline feed 26.

Figure 5:
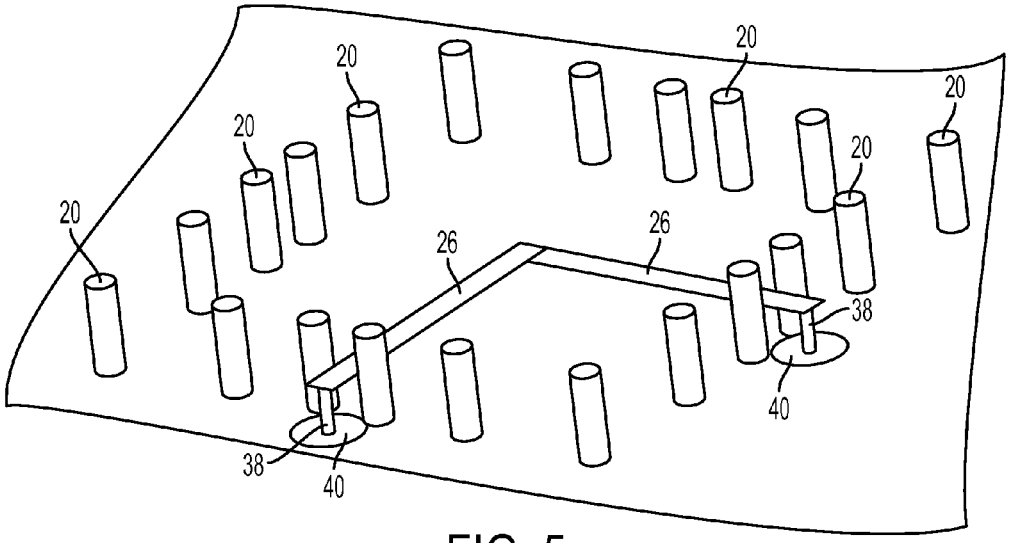
FIG. 5 illustrates details of orthogonal stripline feeds positioned in through holes (vias) according to the invention.

The stripline feeds 26 for exciting the high band element must pass through plated through holes 20 that provide the shorting mechanism for the shorted square ring 16. An illustration of the orthogonal stripline feeds 26 passing through the plated through holes 20 (also termed "vias") is shown in FIG. 5. These plated through holes 20 serve multiple purposes. First, they are used as the shorting mechanism for the shorted square ring 16. Additionally, they act as mode suppressors for the parallel plate mode that can be generated from the stripline feeding the square ring slot 14. Stripline-fed slots can be subject to power loss, low efficiency, and degraded pattern shape as a result of the parallel plate mode. It is known that vias suppress the parallel plate mode in slot-coupled patch antennas fed by stripline feed networks, e.g. by employing vias surrounding the slot. The presence of the vias improves the gain by increasing the available power for radiation. In the present element design, the shorting vias for the low band element improve the efficiency of the high band element by working to eliminate the propagation of the parallel plate mode.

Figure 4:
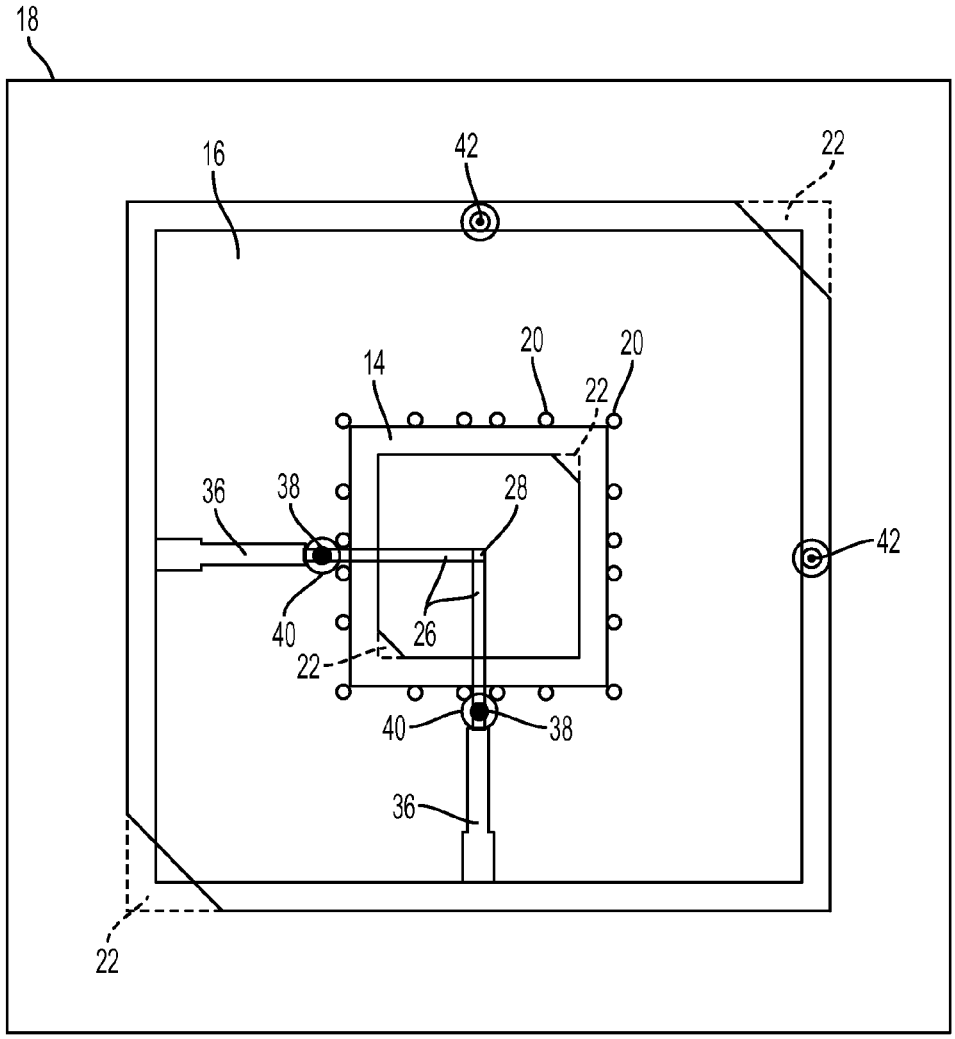
FIG. 4 is a top view of a dual-band dual-CP element according to the invention.

Simulations indicate that stripline feeds 26 have a negative effect on the polarization purity for the low band element. In order to avoid this, the stripline feeds 26 for the square ring slot 14 are transitioned to a microstrip layer 33 present beneath the antenna ground plane. The microstrip layer 33 consists of a microwave substrate layer 34 and orthogonal microstrip feeds 36. Plated through holes 38 are present to provide electrical continuity between the microstrip feeds 36 and the stripline feeds 26. FIG. 4 shows this transition in section view. The transition occurs just outside of the square ring slot 14. The plated through hole 38 passes through a hole 40 in the conductor layer18, and the two transmission lines have matched impedance. A detailed view of this transition is provided in FIG. 5. The presence of the microstrip layer beneath the conductor layer 18, which serves as the antenna ground plane, also provides a convenient location for integrating active components into the antenna design if necessary.

The low band shorted square ring 16 is fed by orthogonal feed probes 42. These feed probes can be realized as coaxial probe feeds or plated through holes from transmission lines present on the microstrip layer that contains the feeding microstrip lines for the high band element.

An element using this technique was designed with the goal to cover the 2.45 GHz and 5.8 GHz ISM bands with dual-CP operation at each band. The element used a feed substrate of thickness 0.004" with a dielectric constant of 2.33. The feed substrate was sandwiched between 0.060" thick dielectric layers with the same properties as the feed substrate. The microstrip layer beneath the antenna ground plane was a 0.030" thick layer of the same dielectric material used on for the antenna.

Figure 6:
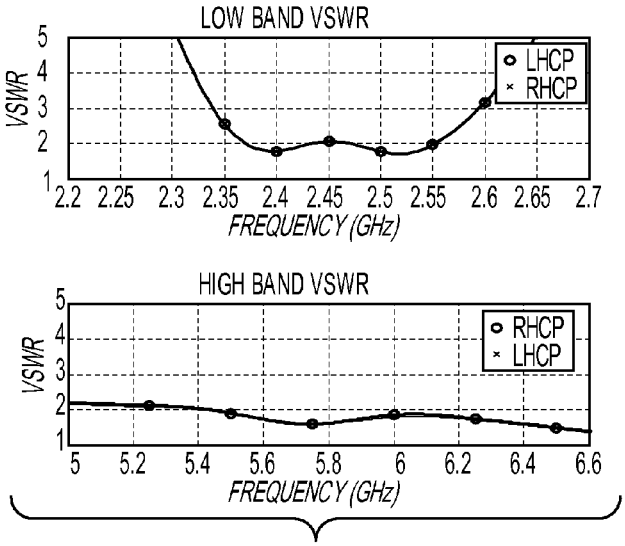
FIG. 6 shows a simulated VSWR for a 4-port element where each band has dual-CP polarization according to the invention.
Figure 7A:
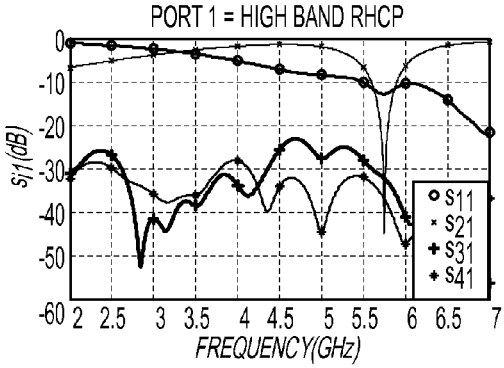
FIGS. 7A-D shows the s-parameters of the 4-port antenna of FIG. 7.
Figure 7B:
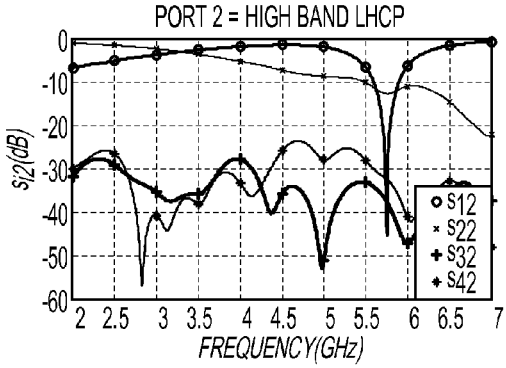
Figure 7C:
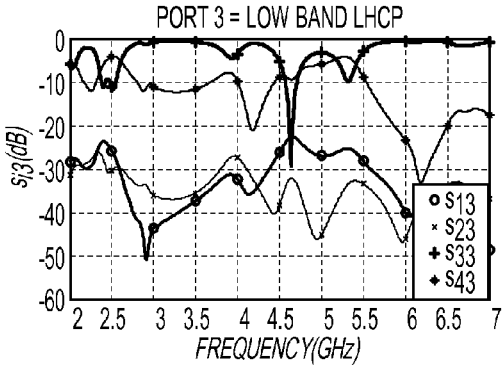
Figure 7D:
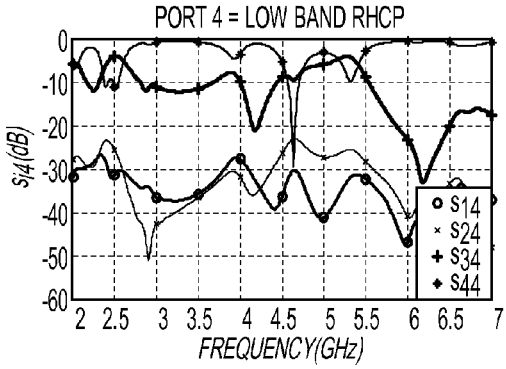

The simulations for this element were carried out using CST Microwave Studio, a computational electromagnetic tool using the Finite Integration Technique. The simulated impedance match was seen to provide excellent results in both polarizations for each band. The simulated VSWR is shown in FIG. 6. The four ports all show a VSWR <2.0:1 in the given frequency band. A more detailed look into the s-parameters of the four-port antenna is provided in FIGS. 7A-D. This figure plots sij for each of the four ports. The band and polarization for the four ports are defined in Table 1.

TABLE 1

Port Definition Used in Simulations of Dual-Band Dual-CP Antenna Element

| Port | Frequency Band | Polarization |
|---|---|---|
| 1 | 5.8 GHz ISM Band | RHCP |
| 2 | 5.8 GHz ISM Band | LHCP |
| 3 | 2.45 GHz ISM Band | LHCP |
| 4 | 2.45 GHz ISM Band | RHCP |

The results indicate that each port has a return loss greater than 10 dB (i.e. sii<−10 dB) in its operational band: this corresponds to a VSWR <2.0:1 as shown in FIG. 6. The plots also show that there is isolation greater than 25 dB between the high and low band ports. The two high band port isolation (|s21|,|s12|) has a maximum value greater than 40 dB at the center of the band. The port-to-port isolation between the low band ports (|s43|,|s34|) is much lower than that of the high band ports. This finding is similar to that in the literature for dual-polarized microstrip patch antennas. When a square patch radiator operates with dual-linear polarizations, an isolation exceeding 20 dB is typically feasible. However, when the corners of the patch are perturbed to achieve dual-CP operation, the orthogonal modes couple strongly to each other. It has also been shown that this port-to-port isolation can be increased at the expense of impedance match and axial ratio.

Figure 8:
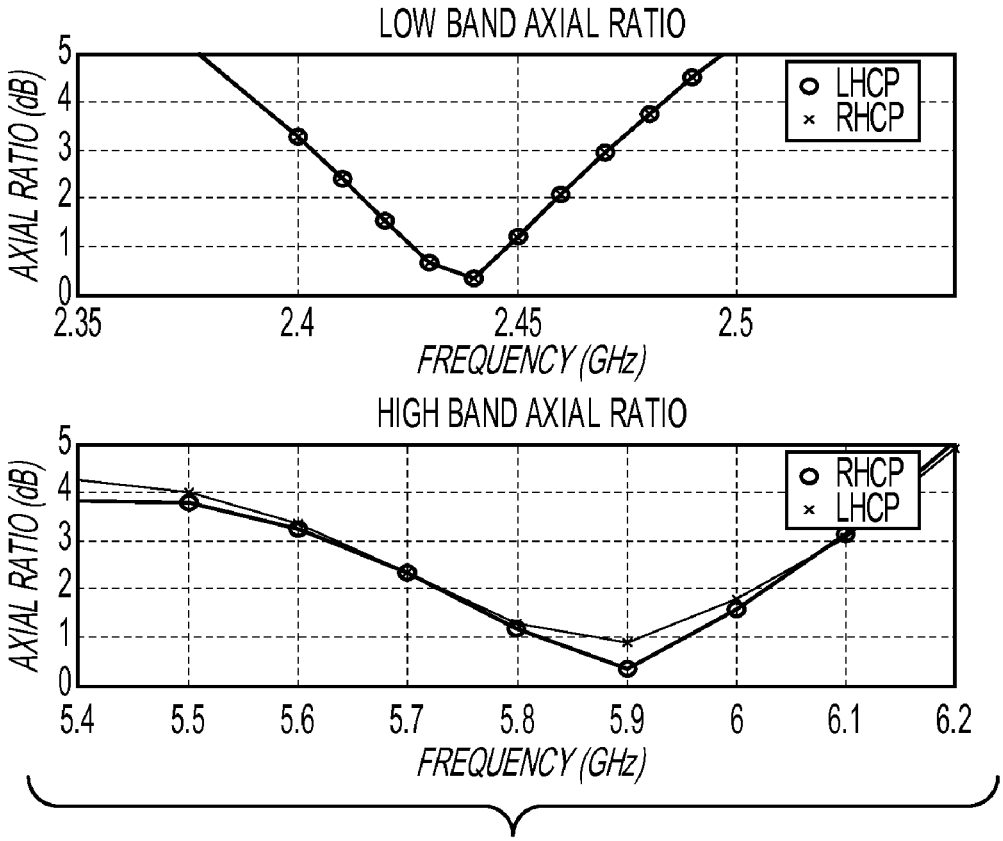
FIG. 8 shows the axial ratio for the low and high band ports of the 4-port antenna of FIG. 7.

In addition to showing good impedance match and isolation performance, this element also shows excellent circular polarization purity (axial ratio) for all polarization states. The axial ratio for the low and high band ports is plotted in FIG. 8. The low band has a minimum axial ratio of 0.33 dB occurring at 2.44 GHz, and the axial ratio is below 3 dB over the majority of the 2.45 GHz ISM band. The high band element has a much broader CP bandwidth, which is typical of slot elements. The high band element has a minimum axial ratio of 0.32 dB for RHCP and 0.89 dB for LHCP. In both cases, the minimum axial ratio occurs at 5.9 GHz. The high band element has an axial ratio better than 3 dB from 5.6-6.1 a bandwidth of 8.5%.

Figure 9A:
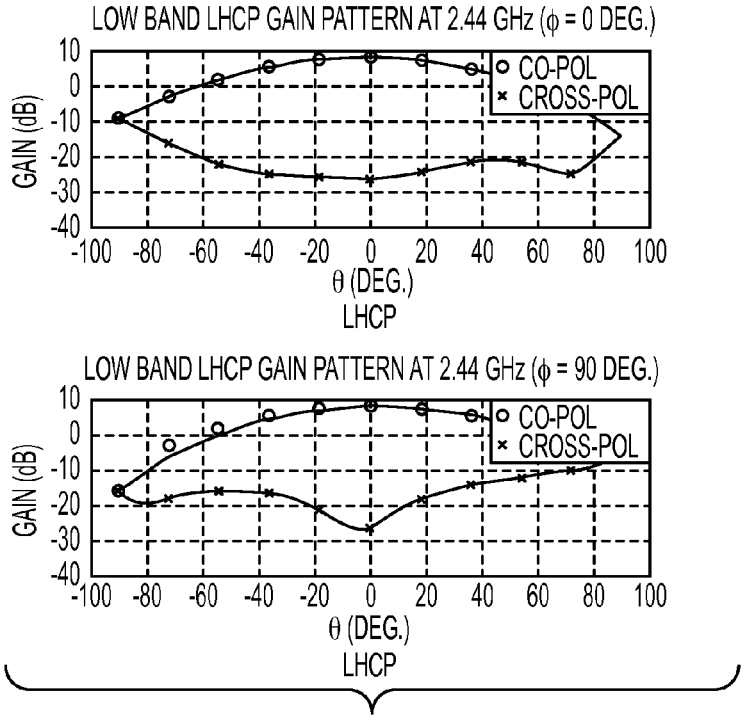
FIG. 9 shows the radiation patterns for each of the CP states for the low band for the 4-port antenna of FIG. 7.
Figure 9B:
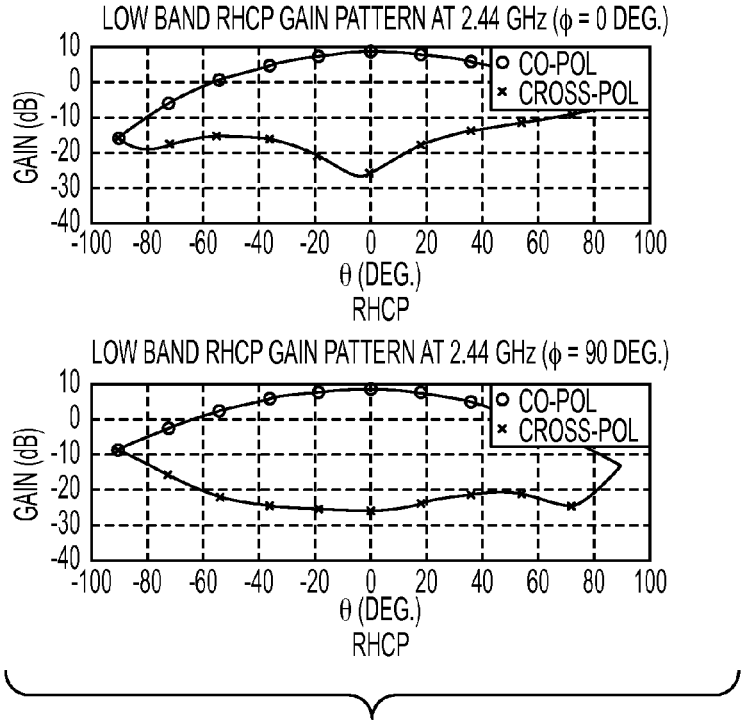
Figure 10A:
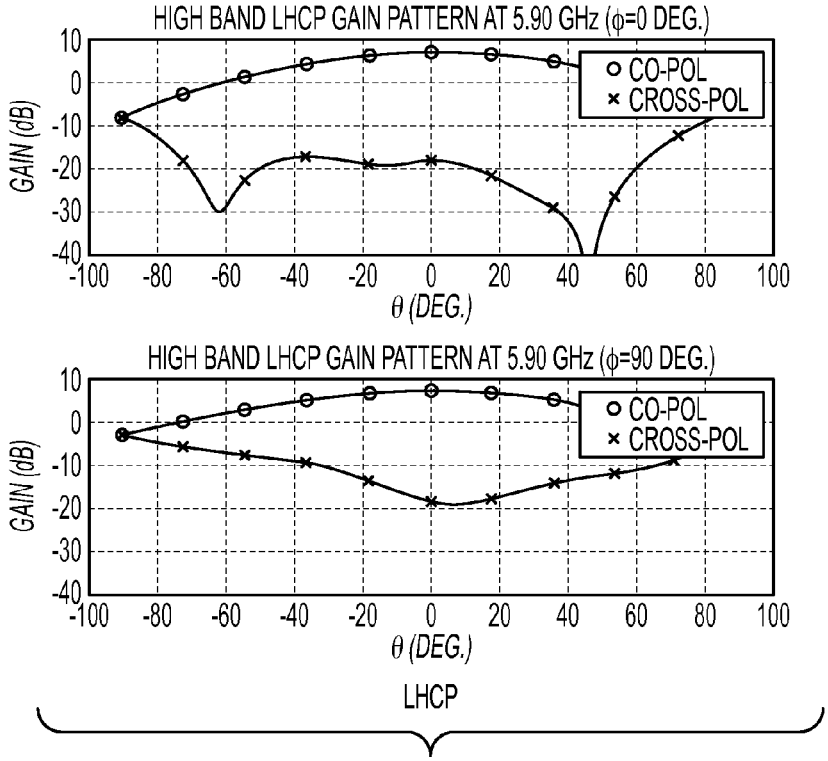
FIG. 10 shows the radiation patterns for each of the CP states for the high band for the 4-port antenna of FIG. 7.
Figure 10B:
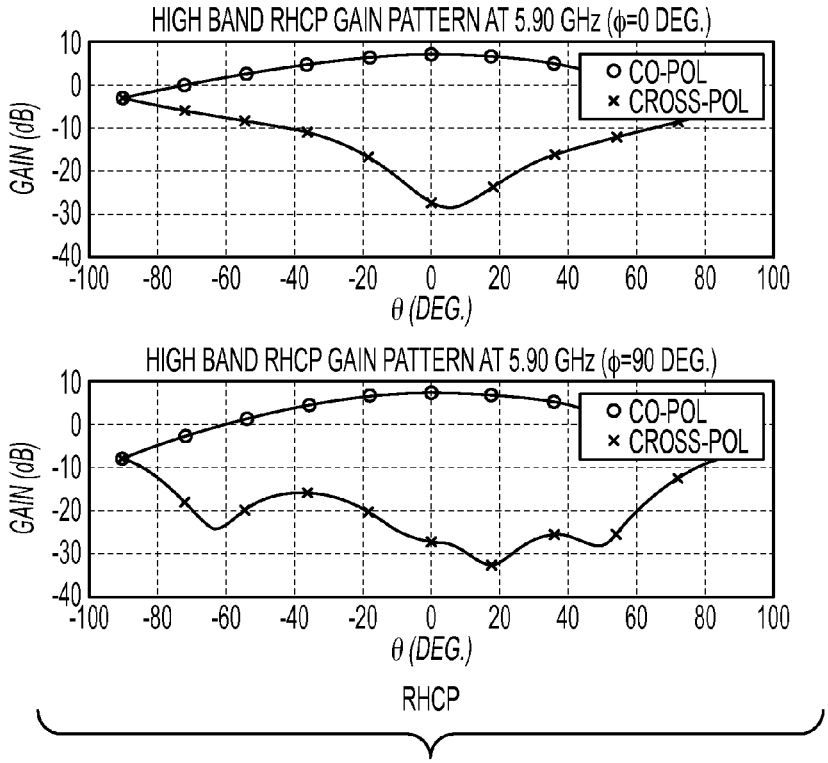
Figure 11A:
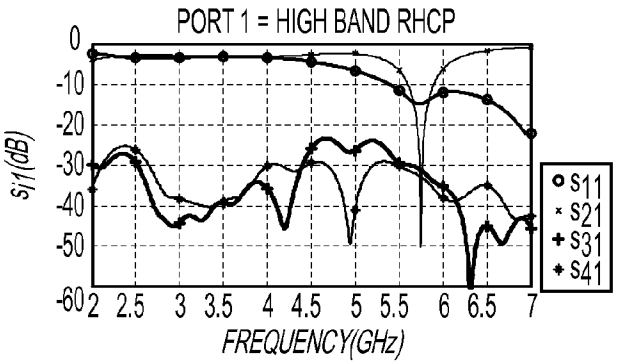
FIG. 11 shows the s-parameters for an element with dual-linear polarization at the low band and dual-circular polarization at the high band according to the invention.
Figure 11B:
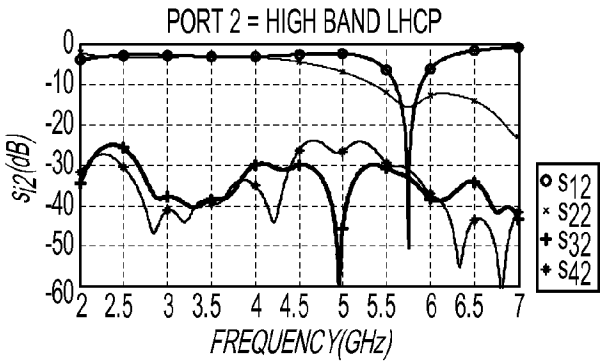
Figure 11C:
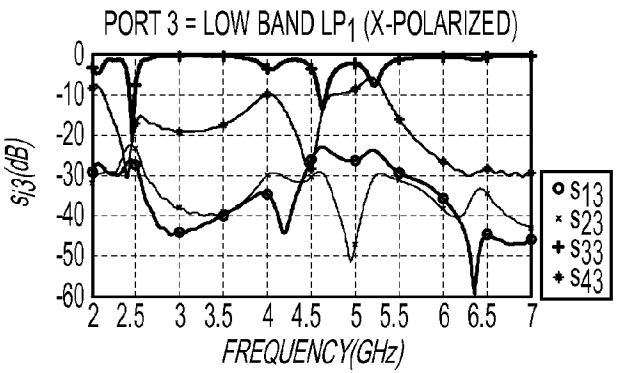
Figure 11D:
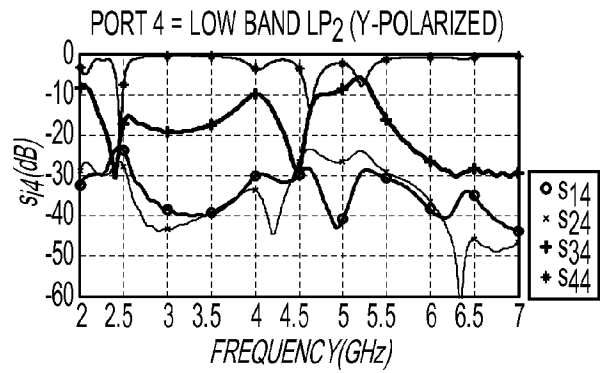
Figure 14:
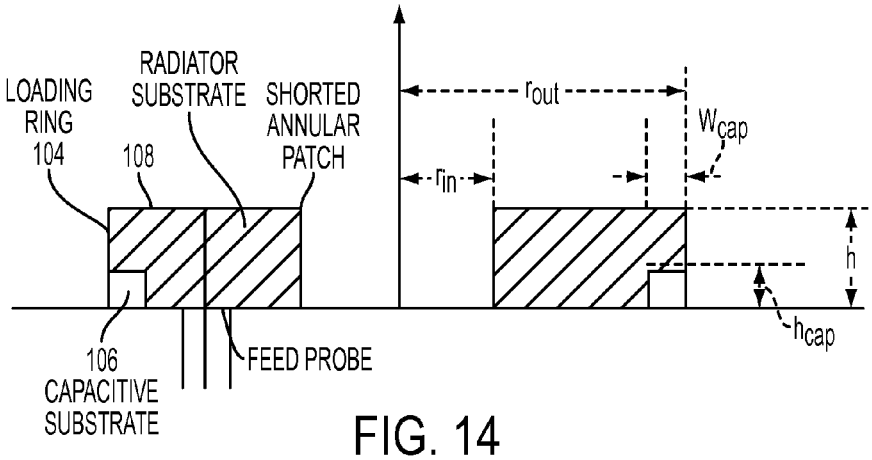
FIG. 14 is a cross-section view of the dual-band element with dual-substrate capacitive loading according to the invention.
Figure 15:
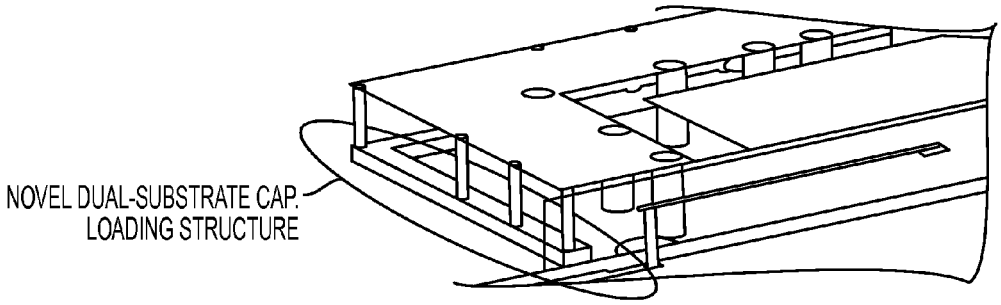
FIG. 15 is an isometric view of the dual-band element showing dual-substrate capacitive loading according to the invention.

The radiation patterns for each of the CP states are plotted in FIG. 9 for the low band and FIG. 10 for the high band. These plots show the co- and cross-pol plots for two orthogonal planes ($\phi$=0°, 90°). These patterns show broadside co-pol patterns in all cases with low cross-pol levels. The low cross-pol levels are reflective of the excellent axial ratio performance in this element.

The previously described element provides each band with dual-CP polarization. However, this element is not restricted to circularly polarized applications. The possible polarization combinations are defined in Table 2.

TABLE 2

Possible Polarization States for Dual-Band Dual-Polarization Antenna Element

| Low Band Polarization | High Band Polarization |
|---|---|
| Dual-Circular Pol. | Dual-Circular Pol. |
| Dual-Circular Pol. | Dual-Linear Pol. |
| Dual-Linear Pol. | Dual Circular Pol. |
| Dual-Linear Pol. | Dual-Linear Pol. |

Referring now to FIG. 4, dual-linear polarization is maintained in either or both of the radiators by retaining the corners (shown by the dotted lines), i.e. by not introducing the triangular perturbations at the two opposing corners of the radiator(s) intended for linear polarization operation. As an example, an element was also designed that has dual-linear polarization at the low band and dual-circular polarization at the high band. The s-parameters for this element are plotted in FIG. 11. This element uses the 2.45 GHz ISM band for the low band and the 5.8 GHz ISM band for the high band. The dual-linear low band and dual-circular high band radiators exhibit excellent port-to-port isolation.

The size of the low band element is the limiting factor in the array lattice spacing for this dual-band element. In cases with large separation between the two bands, the low band element will force a large element spacing that will lead to poor scanning performance and the early introduction of grating lobes at the high frequency. The dual-substrate capacitive loading technique described in Dorsey, W. M.: Zaghloul, A. I., "Size reduction and bandwidth enhancement of shorted annular ring (SAR) antenna." *Antennas and Propagation Society International Symposium,* 2007 *IEEE*, pp. 897-900 (June 2007), and incorporated herein by reference, can be used to reduce the size of the low band element, and thus reduce the overall footprint of the dual-band element. FIGS. 12-15 illustrate a dual-band element 100 with this dual-substrate capacitive loading technique. Capacitive vias 102 are placed around the outer perimeter 104 of the shorted square ring 16. These vias 102 provide electrical continuity to a capacitive load ring 104. A high dielectric constant substrate 106 is present beneath the capacitive load ring 104. The capacitance of the load structure increases as the capacitive patch 108 width increases, the capacitive substrate 106 dielectric constant increases, or the separation between the capacitive patch 108 and the ground plane 18 decreases. The size of the low band element 100 reduces as the capacitance increases, thus facilitating array placement.

Thus, while the present invention has been described with respect to exemplary embodiments thereof, it will be understood by those of ordinary skill in the art that variations and modifications can be effected within the scope and spirit of the invention.

What is claimed as new and desired to be protected by Letters Patent of the United States is:

1. A dual-band, dual-orthogonally-polarized antenna element, comprising:

a first dielectric substrate having a first surface and a second surface;

a conductor layer positioned on the first dielectric substrate first surface, comprising:

a square ring slot; and a shorted square ring; and a feed substrate positioned on the first dielectric substrate second surface, comprising means for exciting the square ring slot and the shorted square ring whereby the square ring slot operates as a high frequency band radiator and the shorted square ring operates as a low frequency band radiator and both the high and low frequency bands radiate substantially simultaneous dual-orthogonally-polarized modes.

2. The antenna element of claim 1, wherein:

the square ring slot and the shorted square ring each include triangular perturbations at opposing corners;

the means for exciting the square ring slot and the shorted square ring comprises:

a pair of orthogonal feed points for each of the square ring slot and the shorted square ring; and a first stripline feed terminated in an open-circuited stub for coupling energy to one of the pair of orthogonal feed points of the square ring slot;

a second stripline feed terminated in an open-circuited stub for coupling energy to the other of the pair of orthogonal feed points of the square ring slot; and wherein the first and second stripline feeds are not coplanar such that each said stub terminates past a center point of the element.

3. The antenna element of claim 2, wherein the feed substrate is positioned between the first dielectric substrate and a second dielectric substrate, and wherein the second dielectric substrate has a conductor layer on a surface opposite the feed substrate.

4. The antenna element of claim 1, wherein the element is configured such that both radiators when excited radiate the same type of dual-orthogonally-polarized mode selected from either dual-Circular Polarization (CP) or dual-Linear Polarization (LP).

5. The antenna element of claim 1, wherein the element is configured such that one radiator when excited radiates a dual-Circular Polarization (CP) and the other radiator a dual-Linear Polarization (LP).

6. The antenna element of claim 1, further comprising a means for dual-substrate capacitive loading.

7. The antenna element of claim 6, wherein the means for dual-substrate capacitive loading comprises a capacitive load ring, capacitive vias positioned around an outer perimeter of the shorted square ring and a high dielectric constant substrate positioned against the capacitive load ring.

8. A dual-band, dual-orthogonally-polarized antenna element, comprising:

a first dielectric substrate having a first surface and a second surface, and having a conductor layer positioned on the first surface, said conductor layer comprising:

a square ring slot;

a shorted square ring; and a pair of orthogonal feed points for each of the square ring slot and the shorted square ring;

a feed substrate having a first surface and a second opposing surface, comprising:

a first stripline feed terminated in an open-circuited stub for coupling energy to one of the pair of orthogonal feed points of the square ring slot; and a second stripline feed terminated in an open-circuited stub for coupling energy to the other of the pair of orthogonal feed points of the square ring slot; wherein the first and second stripline feeds are not coplanar such that each said stub terminates past a center point of the element;

a second dielectric substrate having a first surface positioned against the feed substrate and a second surface with a conductor layer thereon; and a microstrip layer positioned on the conductor layer of the second dielectric substrate, comprising a microwave substrate layer and a pair of orthogonal microstrip feeds; whereby the square ring slot operates as a high frequency hand radiator and the shorted square ring operates as a low frequency band radiator and both the high and low frequency bands radiate substantially simultaneous dual-orthogonally-polarized modes.

9. The antenna element of claim 8, further comprising a plurality of plated through holes outside of the square ring slot.

10. The antenna element of claim 8, wherein:

the square ring slot and the shorted square ring each include triangular perturbations at opposing corners.

11. The antenna element of claim 8, wherein the element is configured such that both radiators when excited radiate the same type of dual-orthogonally-polarized mode selected from either dual-Circular Polarization (CP) or dual-Linear Polarization (LP).

12. The antenna element of claim 8, wherein the element is configured such that one radiator when excited radiates a dual-Circular Polarization (CP) and the other radiator a dual-Linear Polarization (LP).

13. The antenna element of claim 8, further comprising a means for dual-substrate capacitive loading.

14. The antenna element of claim 13, wherein the means for dual-substrate capacitive loading comprises a capacitive load ring, capacitive vias positioned around an outer perimeter of the shorted square ring and a high dielectric constant substrate positioned against the capacitive load ring.

* * * * *